US011830329B2

(12) United States Patent
Kerst et al.

(10) Patent No.: US 11,830,329 B2
(45) Date of Patent: Nov. 28, 2023

(54) CHECKING THE AUTHENTICITY OF VALUE DOCUMENTS

(71) Applicant: GIESECKE+DEVRIENT CURRENCY TECHNOLOGY GMBH, Munich (DE)

(72) Inventors: Erich Kerst, Unterföhring (DE); Thomas Happ, Munich (DE)

(73) Assignee: GIESECKE+DEVRIENT CURRENCY TECHNOLOGY GMBH, Munich (DE)

( * ) Notice: Subject to any disclaimer, the term of this patent is extended or adjusted under 35 U.S.C. 154(b) by 1143 days.

(21) Appl. No.: 16/067,917

(22) PCT Filed: Dec. 21, 2016

(86) PCT No.: PCT/EP2016/002155
§ 371 (c)(1),
(2) Date: Jul. 3, 2018

(87) PCT Pub. No.: WO2017/118466
PCT Pub. Date: Jul. 13, 2017

(65) Prior Publication Data

US 2021/0019976 A1 Jan. 21, 2021

(30) Foreign Application Priority Data

Jan. 5, 2016 (DE) ..... 102016000012.0

(51) Int. Cl.
*G07F 7/10* (2006.01)

(52) U.S. Cl.
CPC ..... *G07F 7/10* (2013.01)

(58) Field of Classification Search
CPC ..... G07D 7/00; G07D 7/12; G07D 7/1205; G07D 7/003; G07D 7/005; G07D 7/121; G07D 7/205; G07F 7/10
See application file for complete search history.

(56) References Cited

U.S. PATENT DOCUMENTS 7,115,879 B2 * 10/2006 Leach ..... G07D 7/12 250/372
7,737,417 B2 6/2010 Giering et al.
(Continued)

FOREIGN PATENT DOCUMENTS

DE 102004035494 A1 2/2006
DE 102008028689 A1 12/2009
(Continued)

OTHER PUBLICATIONS

International Search Report and Written Opinion from PCT Application No. PCT/EP2016/002155.
(Continued)

*Primary Examiner* — Daniel I Walsh
(74) *Attorney, Agent, or Firm* — WORKMAN NYDEGGER

(57) ABSTRACT

A method for testing a value document having a luminescence feature involves guiding the value document past a test sensor in a transport direction. A scanning sequence occurs that repeats itself multiple times upon guiding the value document past the test sensor. The method involves irradiating a test region of the test sensor such that the test radiation is arranged to be remitted by the value document at least partially in a detection spectral range of the test sensor. Excitation radiation is arranged to cause an emission radiation of the luminescence feature in the detection spectral range. The method further involves scanning at least one location-dependent remission spectral value in the test region in the first irradiation phase, irradiating the test region only with the excitation radiation in a second irradiation phase, and scanning at least one location-dependent emission spectral value in the test region after the first irradiation phase.

23 Claims, 5 Drawing Sheets

(56) References Cited

U.S. PATENT DOCUMENTS 8,598,558 B2 12/2013 Bloss et al.
8,817,242 B2 8/2014 Bloss et al.
2001/0006556 A1* 7/2001 Graves ..... G06V 10/143 382/135
2002/0079454 A1* 6/2002 Yamada ..... G07D 7/121 250/361 R
2002/0105654 A1* 8/2002 Goltsos ..... G07D 7/17 356/601
2002/0195571 A1* 12/2002 Kamijo ..... G01N 21/86 250/458.1
2003/0005303 A1* 1/2003 Auslander ..... G06K 7/12 713/176
2003/0057053 A1* 3/2003 Kano ..... G07D 7/121 194/207
2003/0136837 A1* 7/2003 Amon ..... G07D 7/20 340/5.8
2003/0147065 A1* 8/2003 Romano ..... G07D 7/128 356/71
2004/0153408 A1* 8/2004 Jones ..... G06Q 40/02 705/43
2004/0178044 A1* 9/2004 Mori ..... G07D 7/121 194/206
2004/0200978 A1* 10/2004 Kamijo ..... G01N 21/643 250/458.1
2004/0256196 A1* 12/2004 Yu ..... G07D 7/128 194/207
2006/0017957 A1* 1/2006 Degott ..... G07D 7/1205 358/1.14
2006/0115139 A1* 6/2006 Joshi ..... G07D 7/1205 382/137
2008/0135780 A1 6/2008 Giering et al.
2009/0087077 A1* 4/2009 Nireki ..... G07D 7/12 382/135
2010/0128964 A1* 5/2010 Blair ..... G06V 10/141 382/135
2010/0214632 A1* 8/2010 Ikari ..... G06V 10/141 358/475
2010/0302607 A1* 12/2010 Hock ..... H04N 1/0473 358/474
2011/0069174 A1* 3/2011 Rapoport ..... G07D 7/205 348/161
2011/0085157 A1 4/2011 Bloss et al.
2011/0102772 A1 5/2011 Bloss et al.
2012/0217416 A1* 8/2012 Decoux ..... G01N 21/64 250/461.1
2012/0307325 A1* 12/2012 Tagawa ..... H04N 1/401 358/518
2013/0034291 A1* 2/2013 Minin ..... G06V 30/19173 382/137
2015/0310689 A1* 10/2015 Parkov ..... G07D 7/202 382/135
2019/0126659 A1* 5/2019 Dorier ..... B42D 25/382
2020/0273279 A1* 8/2020 Rauscher ..... G07D 7/205
2021/0019976 A1* 1/2021 Kerst ..... G07D 7/205
2021/0248855 A1* 8/2021 Deckenbach ..... G07D 7/1205
2021/0253879 A1* 8/2021 Hardwick ..... C09D 11/037
2022/0277607 A1* 9/2022 Deckenbach ..... G07D 7/121
2022/0366752 A1* 11/2022 Lawandy ..... B42D 25/382

FOREIGN PATENT DOCUMENTS

DE 102008028690 A1 12/2009
EP 3142080 A1 3/2017
JP 4058246 B2 3/2008

OTHER PUBLICATIONS

Search Report from corresponding German Application No. 16819439.7, dated Nov. 26, 2021.

* cited by examiner

CHECKING THE AUTHENTICITY OF VALUE DOCUMENTS

BACKGROUND

The present invention relates to a method and a test sensor and a testing device for testing a value document for authenticity.

When testing the authenticity of value documents, such as for example banknotes, identification documents, securities or the like, it is particularly important to also test their integrity and/or completeness to exclude so-called "snippet counterfeits" or composed counterfeits. In these counterfeits the value document is composed of several, possibly counterfeited partial documents or certain sections of the value document have been replaced by counterfeited sections. Such authenticity tests, which are often based on the evaluation of an emission radiation of a luminescence feature present in or on the value document, are realized by combined test methods and/or test sensors, which effect also a remission or reflection measurement in addition to the actual luminescence measurement.

Such a test sensor, in which a spectrally resolving luminescence sensor comprises a spectral detector with diffraction grating, is described in DE 10 2004 035 494 A1 for example. For remission measurement, a separate detector is used there, for which reason the test sensor has high space requirements and its production requires a high constructive effort.

In addition, a spectrally resolving luminescence sensor is known from DE 10 2008 028 689 A1 and DE 10 2008 028 690 A1, said sensor employing an additional reference radiation source for calibration purposes and a light scanner for ascertaining the position of a value document to be tested. The reference radiation is arranged such that it lies within the spectral range of the luminescence sensor, so that no separate detector is required as light scanner. To be able to ascertain the spectral properties of a value document to be tested in disturbance-free manner, the reference radiation is turned off once an edge of the value document is recognized. However, this has the disadvantage that either no remission measurement can be effected within the value document or that merely a low spatial resolution of the luminescence measurement is achieved at the usual transport speeds of the value documents to be tested.

SUMMARY

To this extent, it is the object of the present invention is to propose a method for testing value documents which permits on the one hand employing a test sensor with low space requirements and construction effort, and on the other hand offers a sufficiently high spatial resolution.

For testing a value document, in particular for its integrity and/or completeness, the value document is guided in a transport direction past the test sensor according to the invention. The value document to be tested here has a security region which extends over the entire expansion to be tested of the value document in the transport direction, and in which or on which a substantially homogeneously distributed luminescence feature is present. The luminescence feature here is incorporated into the volume of the value document in as homogeneous or equally distributed manner as possible or it is applied in the security region as a coating or lacquering of the value document, for example in the form of a luminescent ink or lacquer. Preferably, the security region extends over the entire value document, so that the luminescence feature is present in or on the entire value document in substantially equally distributed manner. The luminescence feature present in or on the security region can be excited to luminescence, thus to phosphorescence and/or fluorescence, by means of an excitation radiation.

According to the invention, the value document is tested by a scanning sequence repeating itself multiple times during the transport of the value document past the test sensor, within the scope of which scanning sequence the value document is irradiated and scanned. The scanning sequence repeated multiple times is followed preferably by the actual test for integrity and/or authenticity, in which the previously scanned spectral values are suitably evaluated.

The scanning sequence repeating itself multiple times here comprises a first irradiation phase and a subsequent second irradiation phase. In the first irradiation phase the security region of the value document is irradiated in a capture region or test region of the test sensor with a test radiation and an excitation radiation. The test radiation here is arranged such that the proportion of the test radiation remitted by the security region is disposed at least partially in a detection spectral range of the test sensor. Accordingly, the excitation radiation is arranged to cause an emission radiation of the luminescence feature, which likewise emits at least partially in the detection spectral range of the test sensor.

During the first irradiation phase, in which the security region is simultaneously irradiated with the test radiation and the excitation radiation, preferably towards the end of the first irradiation phase, a location-dependent remission spectral value is scanned in spectrally resolved manner, which on the one hand comprises proportions of the remitted test radiation and on the other hand comprises proportions of the emission radiation of the luminescence feature emitted due to the excitation radiation. After the first irradiation phase the security region is irradiated in a second irradiation phase in the test region of the test sensor only with the excitation radiation and, preferably at the end of the second irradiation phase, at least one location-dependent emission spectral value is scanned in spectrally resolved manner.

Preferably, the test of the value document is effect with respect to their authenticity. Here, a classification is authentic or inauthentic is effected on the basis of the at least one location-dependent remission spectral value scanned multiple times in spatially resolved manner, in particular in different locations, and the at least one location-dependent emission spectral value scanned multiple times in spatially resolved manner, in particular in different locations.

It should be noted that an intensity of the remission spectral value comprises on the one hand intensity proportions of the remitted test radiation and on the other hand also intensity proportions of an emission radiation of the luminescence feature excited by the excitation radiation, since the security region is irradiated with both the test radiation and the excitation radiation during the first irradiation phase.

In one embodiment, for testing in particular the authenticity of the value document, a spatially resolved remission curve is formed from the location-dependent remission spectral values captured in the course of several scanning sequences, said remission curve reproducing the remission spectral values scanned along the security region in the transport direction. Accordingly, a spatially resolved emission curve is formed from the location-dependent emission spectral values captured in the course of the several scanning sequences, said curve reproducing the emission spectral values scanned along the security region in the transport direction. Each remission/emission spectral value of the remission/emission curve thus reproduces the remitted/emitted radiation intensity at a dedicated position of the security region of the value document, which is caused by the first or second irradiation phase.

The remission curve reproduces the expansion of the value document in the transport direction, while the emission curve reproduces that region of the value document in the transport direction in which the luminescence feature could be detected.

In one embodiment, the value document is finally classified as complete and/or authentic after having been guided past the test sensor completely, when the remission curve and the emission curve have a qualitatively comparable curve progression, since this means that the luminescence feature is present along the entire expansion of the value document in the transport direction. If the two curves have progressions that are not qualitatively comparable, a counterfeit has to be assumed, since the luminescence feature is not present in a counterfeited region of the value document, which results from the emission curve.

For carrying out the method according to the invention a corresponding test sensor according to the invention is employed. Said test sensor comprises a test radiation source which produces a test radiation which is remitted by the value document at least partially in the detection spectral range of the test sensor, and an excitation radiation source which produces an excitation radiation which excites the luminescence feature to an emission radiation, which also emits at least partially in the detection spectral range of the test sensor. Further, the test sensor comprises a scanning unit which scans the test radiation remitted by the value document and the emission radiation emitted by the luminescence feature as location-dependent remission spectral values and location-dependent emission spectral values in the detection spectral range. The detection of the emission spectral values and of the remission spectral values is effected in spectrally resolved manner with preferably more than two spectral channels, in particular more than eight spectral channels and particularly preferably with more than sixteen spectral channels. A control unit of the test sensor coordinates the radiation sources and the scanning unit such that the scanning sequence is repeated continuously while the value document is guided past the test sensor. An evaluation unit of the test sensor finally forms the remission curve and the emission curve in the manner described above and compares their curve progressions qualitatively.

The invention on the one hand offers the advantage that no additional scanning or detection channel is required for capturing the remission spectral values, since both the emission spectral values and the remission spectral values are disposed at least partially in the same detection spectral range of the test sensor. This allows a comparatively compact testing sensor with reduced constructive manufacturing effort.

Furthermore, the invention allows for maximum spatial resolution and intensity of the emission curve, since the luminescence feature is already excited to emit during the irradiation of the value document with the test radiation in the first irradiation phase, and not only after turning off the test radiation with the onset of the second irradiation phase. The local/temporal distance of successive emission spectral values is thereby reduced by the duration of the first irradiation phase in comparison to conventional solutions. Since according to the invention also the first irradiation phase is utilized for the excitation of the luminescence feature, the intensities or amplitudes of the emission spectral values also turn out more clearly, since the luminescence feature can be optically inflated over the maximum available time.

In the evaluation the emission curve and the remission curve are tested for qualitative comparability. This means in particular that no quantitative comparison or signal-theoretical correlation of the curves is effected, but that the two curves are compared merely with respect to their local/temporal widths, which in an authentic value document respectively correspond substantially to its expansion along the transport direction and the duration of the transport past the test sensor. Thus, the two curves, for example, optionally after a suitable noise correction and/or local/temporal low-pass filtering, can be subjected to an edge detection, for example by means of edge or high-pass filters. Previously, the two curves can be processed by means of suitable intensity threshold values to separate significant and/or above-threshold remission/emission spectral values from noise-dependent or disturbance-related spectral values that cannot be attributed to a remission of the test radiation or an emission of the luminescence feature.

Preferably, the evaluation unit ascertains the number of significant and/or above-threshold remission/emission spectral values and/or of the corresponding pixels below the preferably smoothed remission/emission curve. The emission curve and the remission curve are considered to be qualitatively comparable when the emission curve has significant intensities substantially in those location/time positions or pixels where the remission curve likewise forms significant intensities.

Here, the quotient of the pixels with significant intensities in the remission curve and in the emission curve can be formed, so that a qualitative comparability of the two curves can be assumed when this quotient is approximately one. To compensate for noise-related or capture-related measuring errors, a suitable interval can be chosen for the quotient in dependence on the spatial resolution of the two curves, for example, an interval between 0.9 and 1.1 or, preferably, an interval between 0.95 and 1.05.

Alternatively, the evaluation unit ascertains the number of pixels in which the remission curve has significant intensities, but the emission curve has below-threshold values. Here, the value document is then classified as inauthentic when this number of pixels suspected of counterfeiting exceeds a certain threshold value of, for example, 0, 1, 2, etc.

Preferably, the time duration of the first irradiation phase is selected between 0.5 μs and 500 μs, particularly preferably between 1 μs and 50 μs. The ratio between the time duration of the first irradiation phase and the time duration of the entire scanning sequence is preferably between 1:1000 and 1:4, particularly preferably between 1:100 and 1:5. This means that the proportion of the first irradiation phase, in which the value document is irradiated with both the test radiation and with the excitation radiation, of the overall time duration of the scanning sequence, i.e. the total duration of the irradiation with the excitation radiation, is between about 0.1% and 25%, and preferably between about 1% and 20%. The transport speed at which a value document to be tested is guided past the test sensor is between 1 m/s and 13 m/s, preferably it is in the range of 4-12 m/s.

Preferably, the scanning sequence is configured such that the excitation irradiation can be effected without interruption, by the first irradiation phase of a scanning sequence immediately following the second irradiation phase of the preceding scanning sequence. The irradiation with the test radiation is then effected in pulses during the first irradiation phase, in each case interrupted by the second irradiation phase.

The at least one remission spectral value is thereby scanned towards the end of the first irradiation phase, preferably with the end of the first irradiation phase, while the at least one emission spectral value is scanned towards the end of the second irradiation phase, preferably with the end of the second irradiation phase. By this configuration of the scanning sequence on the one hand a maximum spatial resolution of the emission curve can be ensured, and on the other hand a maximum intensity of emission spectral values can be achieved.

In a preferred embodiment of the scanning sequence, the second irradiation phase is immediately followed by a resting phase, in which irradiation is effected neither with the test radiation nor with the excitation radiation. In this embodiment, thus the irradiation with the excitation radiation is likewise effected in pulsed manner, respectively during the first and second irradiation phase and interrupted by the resting phase. The first irradiation phase of a scanning sequence then immediately follows the resting phase of the preceding scanning sequence. Here emission spectral values can be captured also during the resting phase, preferably towards the end of the resting phase, so that a maximum intensity of emission spectral values can be ensured when the luminescence marker still emits after the excitation radiation has been turned off.

The pulsed irradiation with the excitation radiation allows the multiple scanning of emission spectral values within one scanning sequence during and/or after the excitation radiation pulse, so that by comparing the emission spectral values scanned within one scanning sequence also the temporal rise/decay behavior of the luminescence feature can be ascertained in location-dependent manner. This location-dependent rise/decay behavior can then be taken into account in the authenticity test, since the time profile of the emission spectral values within one scanning sequence offers information on the emission properties and the exact type of the tested luminescence feature. The emission spectral values scanned multiple times can be compared with corresponding location-dependent reference spectral values, for example, which were determined beforehand for the value document in question.

Preferably the value document is irradiated with a spectrally narrow-band test radiation, so that said test radiation is verified only in one or few spectral channels of the detector. The test radiation is preferably not suitable to significantly excite luminescence in the value document.

Further, the value document is irradiated with a preferably narrow-band excitation radiation, wherein the excitation radiation takes place in the ultraviolet (UV), in the visible (VIS) and/or in the infrared spectral range (IR). It can also comprise several different wavelength ranges. It is ensured thereby that the test radiation causes no or only a weak emission radiation of the luminescence feature in the detection spectral range, so that the scanned emission spectral values can be attributed as exclusively as possible to the excitation irradiation, and as little as possible to the test irradiation.

Preferably, the test radiation source comprises an LED or semiconductor laser radiation source, e.g. an edge-emitting laser diode. Particularly preferably, the test radiation source comprises a narrow-band VCSEL or surface-emitting radiation source. Accordingly, the excitation radiation source preferably comprises an LED or semiconductor laser radiation source, particularly preferably a narrow-band VCSEL, or surface-emitting radiation source.

To allow the best possible evaluation of the remission and emission values, the remission spectral values and/or the emission spectral values are preferably corrected in terms of noise and disturbing influences. Thus, scatter radiation proportions or electronic and/or electromagnetic disturbing radiation proportions can be eliminated by an offset correction from the remission spectral values and/or emission spectral values, wherein the corresponding correction parameters are ascertained either in advance by scanning a reference substrate with the test sensor or, preferably, by scanning during the authenticity test at time points when there is no value document guided past the test sensor (dark measurement), for example before the start of the authenticity test or between two successive value documents to be tested.

The remission spectral values are preferably further corrected such that they are incorporated only in those scanned spectral proportions that can actually be attributed to the test irradiation and its remission by the value document. Accordingly, those scanned spectral proportions and/or intensity proportions or intensities are filtered out and/or eliminated from the scanned remission spectral values which can be attributed to an emission radiation of the luminescence feature resulting from the excitation irradiation. In order to efficiently differentiate between the respective spectral proportions of the remitted remission irradiation and the emission radiation emitted by the luminescence feature, particularly a narrow-band test radiation is suitable, so that the remission/emission spectral values scanned in spectrally resolved manner can be filtered efficiently.

Instead of spectral proportions also intensity proportions or intensities related to the remitted radiation can be ascertained.

Alternatively, from the emission spectral values respectively measured at the later time point and their time profile, the contribution respectively expected at the earlier time point of scanning the remission spectral value can be interpolated and thus deducted with good approximation.

A non-negligible local or temporal offset can form between the remission curve and the emission curve at higher transport speeds, since the value document to be tested is moved further between the scanning of the remission spectral values and the scanning of the emission spectral values. This offset can be compensated within the scope of the authenticity test by shifting the emission curve relative to the remission curve by exactly that time interval which lies between the scanning of the remission spectral values and the scanning of the emission spectral values.

Together with the transport device which guides the value document past the test sensor during the authenticity test in such a manner that the test region of the test sensor moves continuously across the security region of the value document, the test sensor according to the invention forms a testing device according to the invention. Here, the transport speed of the value document and the time duration of a scanning sequence are preferably mutually coordinated such that the resulting spatial resolution of the remission curve and/or emission curve is sufficiently high to allow a reliable authenticity test. A sufficient spatial resolution is given for example when the borders of the value document or of the security region can be detected accurately, or when the spatial resolution is sufficient to map important detail of the appearance or of an imprint of the value document.

BRIEF DESCRIPTION OF THE DRAWINGS

Further features and advantages of the invention will result from the present description of embodiment examples according to the invention and further alternative embodiments in connection with the following drawings, which show:

FIG. 5 FIGS. 5*a* and 5*b* two preferred embodiments of the test sensor according to the invention with separate irradiation paths (FIG. 5*a*) and a common irradiation path (FIG. 5*b*).

DETAILED DESCRIPTION OF VARIOUS EMBODIMENTS

Figure 1:
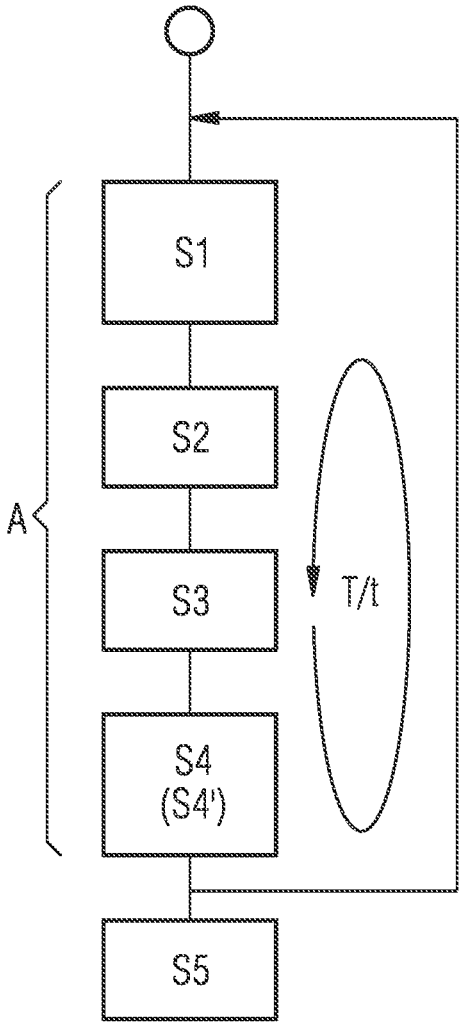
FIG. 1 the steps of the sequence of the method of the test method according to the invention.
Figure 3A:
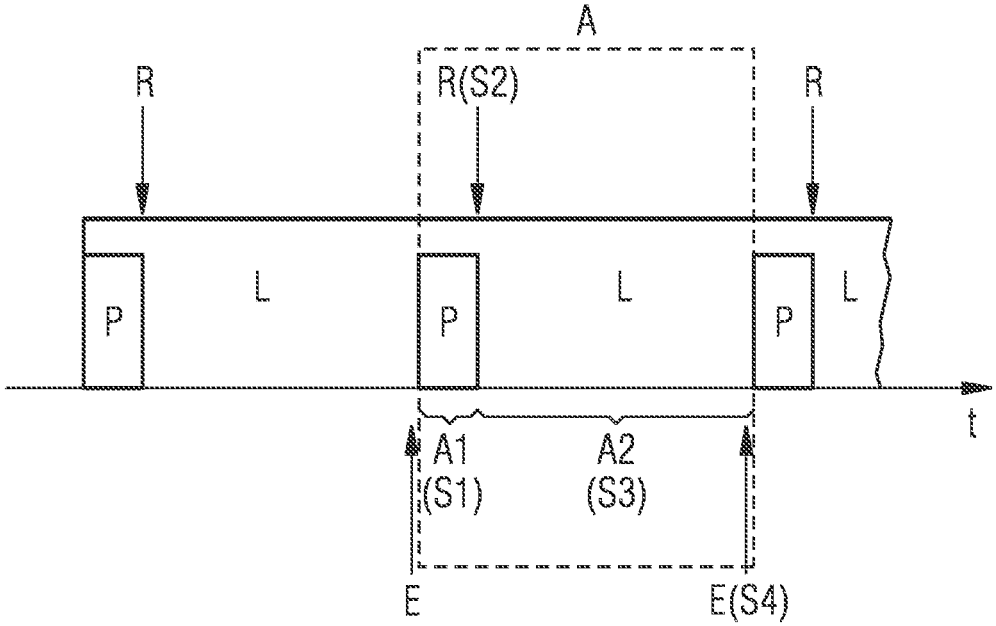
FIGS. 3*a* and 3*b* two embodiments of a scanning sequence with continuous excitation radiation (FIG. 3*a*) and pulsed excitation radiation (FIG. 3*b*)
Figure 3B:
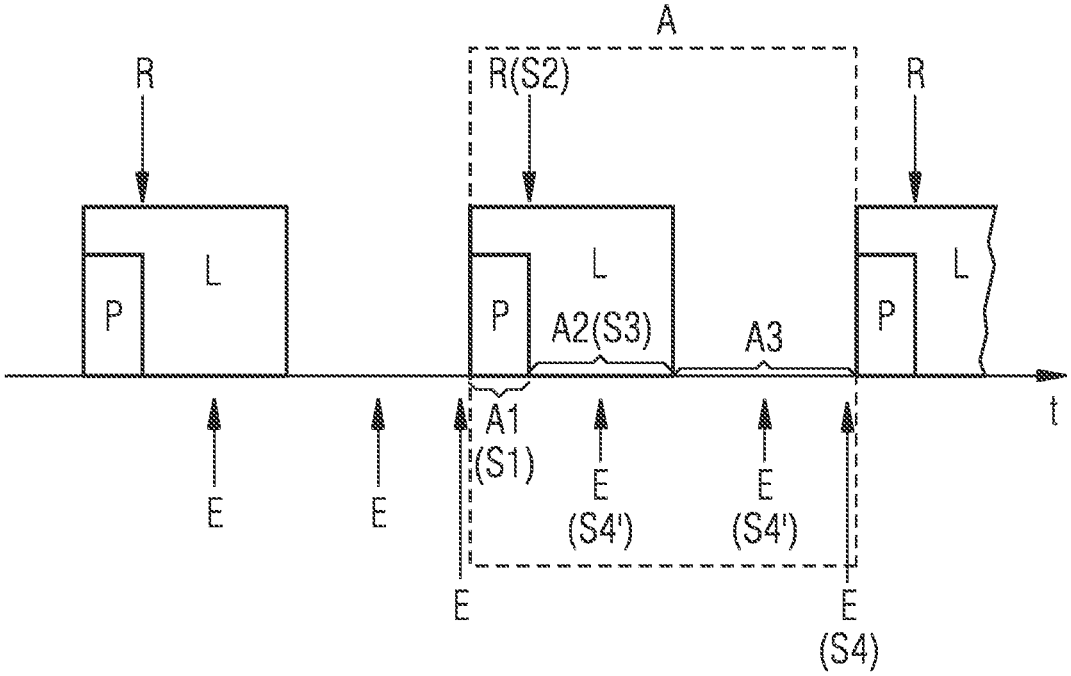
Figure 4A:
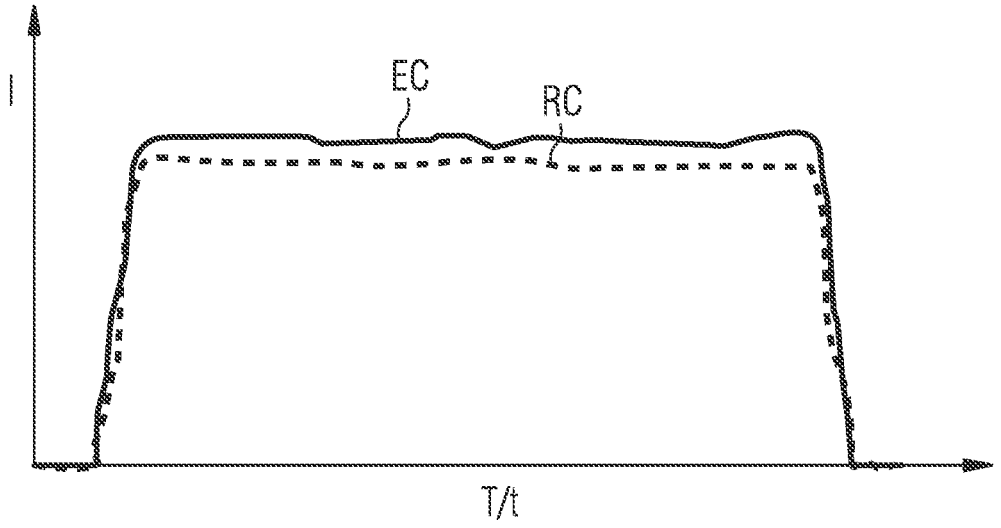
FIGS. 4*a* and 4*b* quantitative representations of the emission and remission curve for the authentic value document according to FIG. 2*a* (FIG. 4*a*), and the counterfeited value document according to FIG. 2*b* (FIG. 4*b*)
Figure 4B:
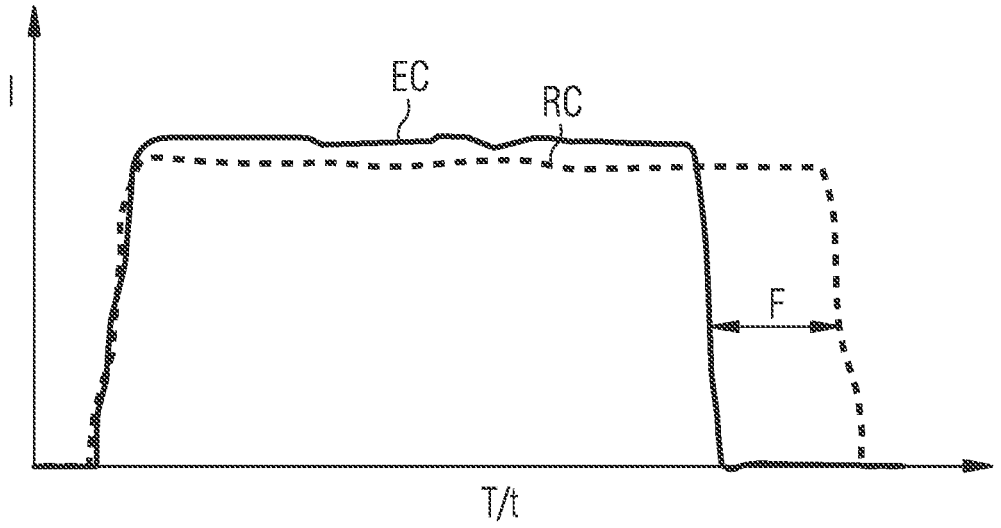
Figure 5A:
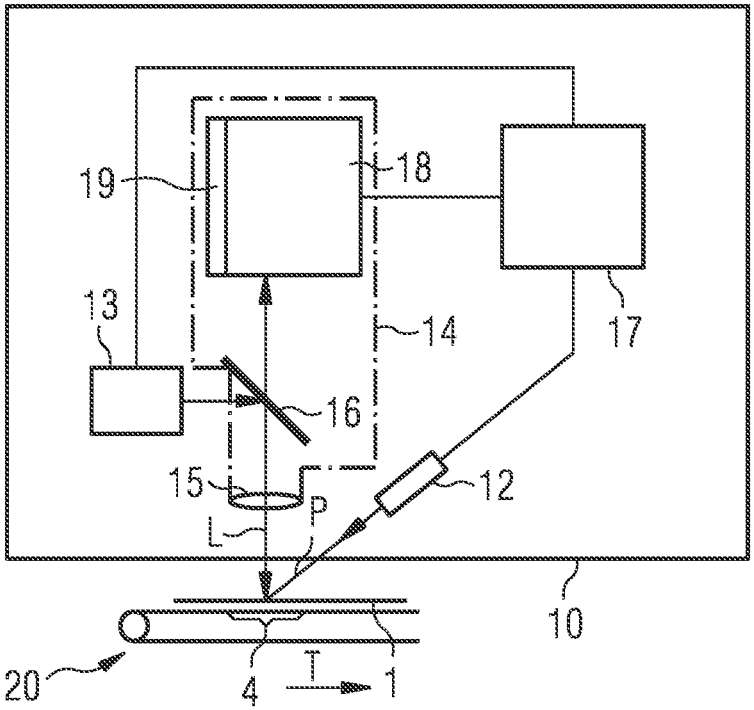
Figure 5B:
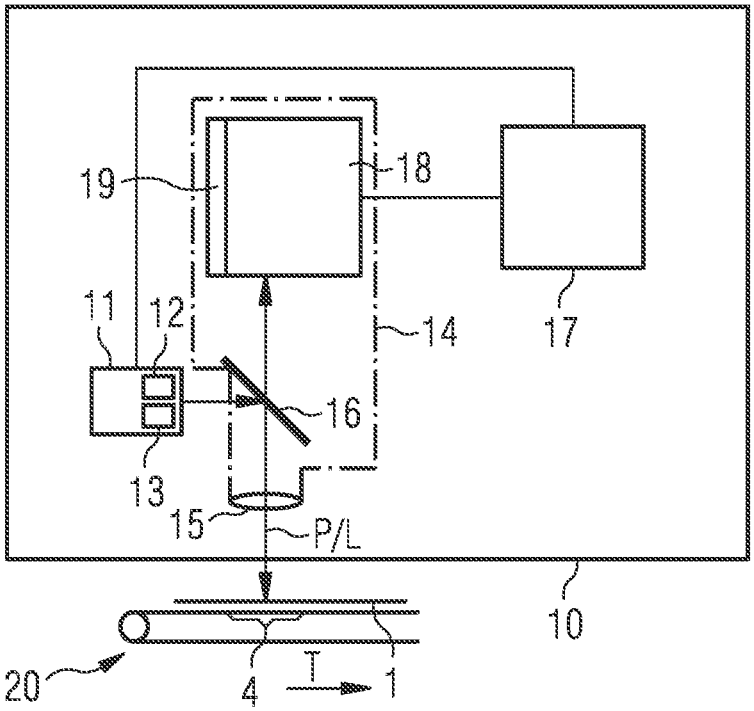

FIG. 1 shows the steps of a method for testing the authenticity of a value document 1 with one of the test sensors 10 shown in FIGS. 5*a* and 5*b*, comprising a scanning sequence A repeating the steps S1 to S4 multiple times and a final evaluation step S5. The scanning sequence A is illustrated in FIGS. 3*a* and 3*b*, while FIGS. 4*a* and 4*b* illustrate the evaluation. A value document 1 testable with this method is shown in FIGS. 2*a* and 2*b*.

Figure 2A:
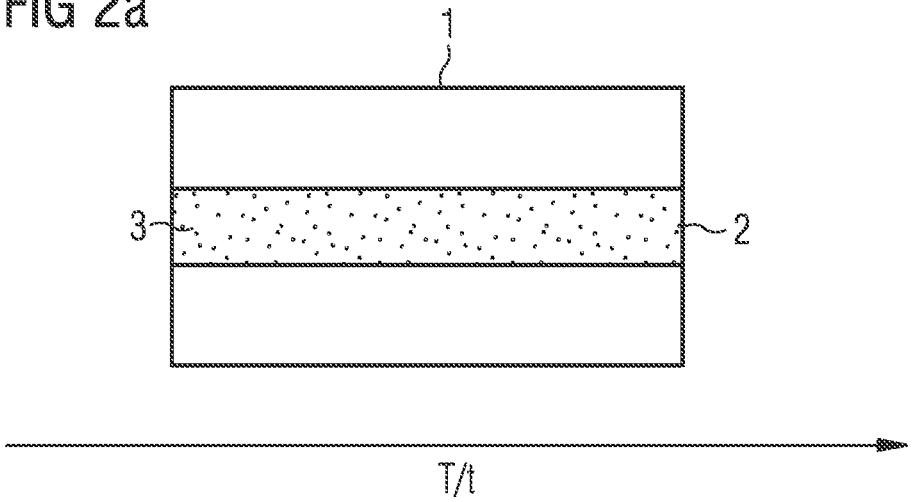
FIGS. 2*a* and 2*b* illustrations of an authentic value document (FIG. 2*a*) and a counterfeited value document (FIG. 2*b*)

FIG. 2*a* illustrates an authentic value document 1 having a security region 2, in which or on which one or several luminescence features 3 are present, which are excited to fluorescence or phosphorescence by a suitable excitation radiation L. In particular, the luminescence feature 3 can be excited with longer wavelengths (Stokes luminescence) or shorter wavelengths (anti-Stokes luminescence or upconverter) to emit in a specific emission spectral range. The luminescence feature 3 here is incorporated as homogeneously or in as evenly distributed manner as possible over as large regions as possible of the volume of the value document 1, which can consist of paper or plastic (polymer), or, alternatively, is printed or lacquered onto the security region 2 over the full area.

The security region 2 is equipped with the luminescence feature 3 preferably along the entire expansion of the value document 1 in a transport direction T. Deviating from FIG. 2*a*, the security region 2 can also extend over the entire area of the value document 1 or adopt almost any desired contiguous geometric shapes. These preferably extend over the entire expansion of the value document 1 in the transport direction.

Figure 2B:
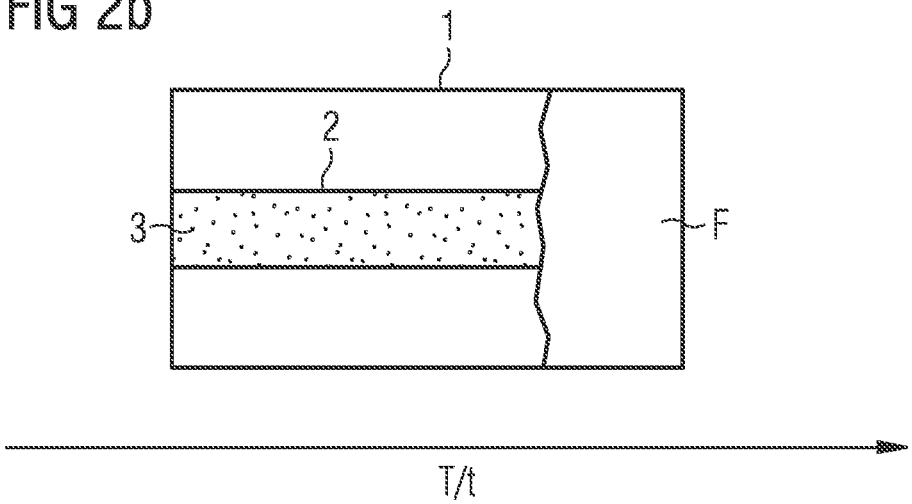

In contrast, FIG. 2*b* illustrates a counterfeited value document 1, in which in a counterfeited area F a so-called "snippet counterfeit" is present, which impairs the security region 2, in contrast to that of FIG. 2*a*, such that the luminescence feature 3 is no longer detectable over the entire expansion of the value document 1 in the transport direction T.

The method according to the invention according to FIG. 1 on the one hand is based on the consideration that a remission evoked on the value document 1 by a test radiation P is available for detection or scanning and can be evaluated significantly faster than a luminescence emission of the luminescence feature 3 evoked by the excitation radiation L. On the other hand the method according to the invention is based on the discovery that an irradiation of the value document 1 with the test radiation P can also be realized temporally parallel and in disturbance-fee manner with the irradiation of the value document 1 by the excitation irradiation L, in order to optically inflate and excite the luminescence feature 3 to luminescence emission significantly more efficiently than by a sequential irradiation with the test radiation P and the excitation radiation L. The optical inflating of the luminescence feature 3 already during the irradiation of the value document 1 with the test radiation is P is expedient in particular with phosphorescence features, since their excitation times and/or rise or decay times can be in the range of a few microseconds up to a number of milliseconds.

While the value document 1 is guided along the transport direction T and over a time axis t past the test sensor 10, the steps S1 to S4 of the scanning sequence A are repeated multiple times. In a first step S1 the value document 1 is first irradiated within the scope of a first irradiation phase A1 with both the test radiation P and the excitation radiation L. An accordingly adapted scanning unit 14 of the test sensor 10 then in step S2 scans spectral proportions of both the remitted test radiation P and the emission radiation emitted by the luminescence feature 3 resulting from the first irradiation phase A1. Instead of spectral proportions, spectrally superimposed intensity proportions can be scanned by the scanning unit 14.

This situation is also represented in FIGS. 3*a* and 3*b*, which illustrates two different variants of a scanning sequence A according to the invention in the region respectively marked with dashed lines. It is shown there that the value document 1 is irradiated during the first irradiation phase A1 with both the test radiation P and the excitation radiation L, while at the end of the first irradiation phase A1 the scanning of remission spectral values R is effected according to step S2, said remission spectral values comprising both remitted intensity proportions of the test radiation P and emitted intensity proportions of the emission radiation of the luminescence feature 3. The test radiation P here is remitted immediately by the value document 1, so that no waiting or integration times are required in addition to the pure light transit time, but the scanning of the remission spectral values R in step S2 can be effected directly towards or at the end of the first irradiation phase A1.

Preferably, the remission spectral values R are scanned synchronously and very fast, so that the intensities allocatable to the individual spectral channels of the scanning unit 14 can be evaluated in parallel. The fast scan prevents a blurring of the respective spectral channels while the value document 1 moves in the transport direction T. The scanning step S2 can be effected here by means of photo diodes and suitable sample-and-hold circuits, or by CCD or CMOS detectors with charge accumulation and a suitable array architecture with synchronous shifting of the charges of an entire spectral line to a darkened storage region of the test sensor 10.

At the transition between the first irradiation phase A1 and the second irradiation phase A2, thus immediately after the scanning step S2, the test radiation P is turned off, while the irradiation with the excitation radiation L is continued and lasts during the entire second irradiation phase A2 (step S3). In step S4, the scanning unit 14 is finally read out again to ascertain emission spectral values E, which have sufficiently strong emission intensities due to the optical inflating of the luminescence feature 3 already during the first irradiation phase A1. The separate scanning of emission spectral values E without superimposed spectral proportions of the remitted test radiation P in step S4 allows a particularly accurate and reliable testing of the luminescence feature 3, since otherwise incorrect or deviating emission radiations, caused by counterfeited luminescence features for example, possibly cannot be recognized reliably when the emission spectral values E are not scanned with sufficient intensity or are overlapped by the test radiation P.

As shown in FIG. 3*a*, the scanning sequence A is repeated continuously and persistently at least for such a time until the value document 1 has been guided past the test sensor 10 in its entirety, so that for the authenticity test in step S5 remission spectral values R and emission spectral values E along the entire expansion of the value document 1 in the transport direction T are present at a spatial resolution which depends on the one hand on the total duration of the scanning sequence A, and on the other hand on the transport speed of the value document 1.

FIG. 3*a* further illustrates that the first irradiation phase A1 is of a much shorter duration than the second irradiation phase A2. The test radiation P is directed onto the value document 1 with very short pulse lengths, so that the emission spectral values E decisive for the authenticity test are disturbed by remitted test radiation P as minimally as possible and also an as high as possible spatial resolution is achieved. Therefore, the temporal proportion of the first illumination phase A1 of the entire scanning sequence A is between 0.1% and 25%, and preferably between 1% and 20%. Here the duration of the entire scanning sequence A is preferably formed by the sum of the durations of the first illumination phase A1 and of the second illumination phase A2. The absolute time duration of the first irradiation phase A1, thus the pulse length of the test irradiation P, is in the range of 0.5 μs to 500 μs here, preferably in the range of 1 μs to 50 μs.

At such short pulse lengths of the test radiation P it can be required, in dependence on the specific configuration of the scanning unit 14 and an evaluation unit 17 of the test sensor 10, to effect the scanning of the remission spectral values R (step S2) only after completion of the first irradiation phase A1, in order to take account of the time constant of an either parasitically occurring or intentionally built-in low-pass filtering of the scanning unit 14, since it is then necessary to wait for a certain time until the remission spectral values R evoked by the short pulse length of the test radiation P have formed also electronically and can be scanned efficiently.

The value document 1 is further irradiated continuously with the excitation radiation L in the second irradiation phase A2 (step S3) after turning off the test radiation P to further optically inflate the luminescence feature 3. Towards or with the end of this phase of the optical inflating, thus at the end of the second irradiation phase A2, emission spectral values E can then be scanned (step S4) which are substantially attributable exclusively to the emission radiation of the optically inflated and/or maximally excited luminescence feature 3.

Immediately following the scanning of the emission spectral values E in step S4, the scanning sequence A begins again with the first irradiation phase A1 by effecting a further pulsed irradiation with the test radiation P (step S1), as shown in FIG. 3*a*.

Although FIG. 3*a* provides only one scanning of emission spectral values E per scanning sequence (step 4), also several emission spectral values E can be scanned offset in time (step S4') during the course of the second irradiation phase A2, in order to thereby map also the rise/decay behavior of the luminescence feature 3, making it usable for a location-dependent authenticity test. This is shown for example by the alternative configuration of the scanning sequence A according to FIG. 3*b*, in which the second irradiation phase A2 is followed by a resting phase A3, before a further scanning sequence A begins again with the first irradiation phase A1.

In the scanning sequence A in accordance with FIG. 3*b* not only the test radiation P is pulsed, but also the excitation radiation L, albeit with a much longer pulse length. The irradiation with pulsed excitation radiation L allows a one-time (step S4) or multiple (steps S4', S4) scanning of emission spectral values E during and/or after the pulsed irradiation with the excitation radiation L, i.e. within the second irradiation phase A2 and/or the resting phase A3, thus for example once within and once at the end of the second irradiation phase A2 (step S4'), and finally towards or at the end of the resting phase (step S4), shortly before the onset of the first irradiation phase A1 of the next scanning sequence A. Here, too, a location-dependent evaluation of the rise/decay behavior of the luminescence feature 3 can be effected and thus lead to an improved authenticity test which takes into account not only the mere presence of a luminescence feature 3 over the entire expansion of the value document along the transport direction T, but also the time behavior of the emission of the luminescence feature 3 in location-dependent manner. In a preferred embodiment a scanning of emission spectral values E is effected relatively shortly after the end of the first irradiation phase A1 and/or the scanning of the remission spectral values R, so that the luminescence contribution to the remission spectral values R can be estimated more accurately.

Therefore, the time proportion of the first illumination phase A1 of the entire scanning sequence A is between 0.1% and 25%, and preferably between 1% and 20%. The absolute time duration of the first irradiation phase A1, thus the pulse length of the test irradiation P, here is within the range of 0.5 μs to 500 μs, preferably in the range of 1 μs to 50 μs. Preferably, the duration of the entire scanning sequence A is determined by the sum of the durations of the phases A1+A2+A3 and therein dominated by the duration of the second illumination phase A2, i.e. also the duration of the resting phase A3 is dimensioned to be relatively short. The absolute time duration of the resting phase A3 is preferably in the range of 0.1 μs to 500 μs, in particular in the range of 10 μs to 100 μs. This allows a particularly good inflating also of relatively slow luminescence features 3 with good spatial resolution at the same time.

Deviating from FIG. 3*b*, the scanning of the remission spectral values R, as already described in connection with FIG. 3*a*, can also be effected only after conclusion of the irradiation by the test radiation P, thus only within the irradiation phase A2, to compensate for possible electronics runtimes of the scanning unit 14.

For evaluating the measured remission R and emission spectral values E in step S5, correction and compensation methods are applied first. For this purpose the two spectral values R, E are subjected to an offset or background correction, in which any spectral proportions caused by scatter radiation or electronic/electromagnetic radiation are eliminated. The correction parameters employed here either can be firmly predetermined in the evaluation unit 17 or can be ascertained only in the course of the test method according to the invention, for example by dark measurements without test irradiation P and excitation irradiation L at time points at which no value document 1 is present. Alternatively or additionally it is also possible to normalize the scanned remission/emission spectral values R, E to predetermined or currently detected intensities or to reference spectral values measured by means of a calibration substrate.

In the case of the remission spectral values R in narrow-band test irradiation P preferably only one spectral channel of the scanning unit 14 is read out, and in the case of a broader spectrum of the remitted test irradiation P several spectral channels are read out simultaneously. Only those spectral channels of the scanning unit 14 are evaluated here which correspond to the spectrum of the remitted test irradiation P by eliminating spectral proportions from the remission spectral values R which result from the emission radiation excited during the first irradiation phase A1. The relevant parameters of this spectral filtering in turn can be either firmly predetermined in the evaluation unit 17 or ascertained in the course of the test method. Likewise, in the case of a spectral overlap between the emission radiation and the test radiation, the intensity contribution of the emission radiation can be corrected on the corresponding spectral channels of the remission spectral values R. In this case, estimated values are ascertained for the time profile of the intensity of the emission radiation on the basis of a linear or exponential model which model the temporal emission behavior of the luminescence feature 3. In this manner, disturbing proportions are eliminated from the scanned remission spectral values R which result from rise/decay effects of the emission radiation during the first irradiation phase A1.

If a luminescence feature 3 with a short rise/decay time in comparison to the time duration of the first irradiation duration A1 is tested, those spectral proportions which are attributable to an emission radiation of the luminescence feature 3 during the first irradiation phase A1 can be eliminated directly at least approximately, thus without a temporal modeling of the rise/decay behavior of the luminescence feature 3.

The remission spectral values R corrected in this manner are then stored in a memory of the test sensor 10 for evaluation by the evaluation unit 17 together with the associated measurement positions in the value document 1. Likewise, the corrected emission spectral values E are stored together with the associated measurement positions.

The location-dependent, optionally corrected remission spectral values R and/or emission spectral values E are then respectively summarized to form a spatially resolved remission curve RC and/or emission curve EC over the time axis t.

Subsequently, a smoothing of one or both curves RC, EC is effected, for example by computing a moving average value, a moving median or a moving percentile of several adjacent spectral values R, E of the respective curve RC, EC. Optionally, the curves RC, EC can additionally be normalized to a suitable intensity value, for example to the respective intensity maximum or the respective intensity median, however wherein, in particular in the case of the emission curve EC, an additional test in terms of the overshooting of an absolute lower intensity threshold is expedient in order to be able to identify any counterfeits with a feature intensity that is too weak.

In dependence on the spatial resolution of the scanning sensor 19 and the transport speed of the value document 1 along the transport direction T a motion compensation can be carried out in addition. For this purpose, the two curves EC, RC are mutually shifted to the extent of the time interval between the scanning of the remission spectral values R (step S2) and the scanning of the emission spectral values E (step S4). At a high spatial resolution in particular it is thus possible to correct a local/temporal offset between the remission spectral values R recorded at a somewhat earlier time and the emission spectral values E recorded at a somewhat later time in view of the qualitative comparison of the curves RC, EC.

Subsequently, the actual local dimension of the value document 1 along the transport direction T is determined by an edge detection of the remission curve RC, for example by digital edge or high-pass filtering. In the simplest case, those extreme positions of the remission curve RC can be ascertained where the remission spectral values R rise above the intensity median or fall below the intensity median again. There is a lower susceptibility to noise, however, when a linear interpolation is carried out between a suitable intensity quantile (e.g. 75%, almost corresponds to white) and a minimum of the remission curve RC or an intensity quantile of about 5%, and to ascertain therefrom those (two) positions of the remission curve RC where the remission curve RC intersects the intensity quantile of 50% (or alternatively the average value of the 5% and the 75% quantile). From the difference of the two positions there results the expansion of the value document 1 along the transport direction T. The intensity quantiles are determined here in dependence on the respective appearance or the remitted intensity distribution to be expected of the value document 1 to be tested.

The authenticity of the tested value document 1 and/or its integrity or completeness is then determined to exclude a snippet counterfeit finally when the width of the corrected remission curve RC is qualitatively comparable to the width of the corrected emission curve EC. An index for the completeness of the value document 1 here is the quotient of the number of the curve points (or pixels) with significant or above-threshold emission spectral values E and the number of curve points (or pixels) with significant or above-threshold remission spectral values R, which substantially correspond to the expansion of the value document 1 along the transport path T. The significant emission spectral values E then are such values whose intensity is between lower and upper threshold values which are predetermined or ascertained during the test.

By means of the curve progressions of FIGS. 4*a* and 4*b* there results in this manner an index (quotient) of about 1 for the authentic banknote according to FIG. 2*a* (see FIG. 4*a*) and an index (quotient) of about 0.82 for the counterfeited value document according to FIG. 2*b* (see FIG. 4*b*).

The method according to the invention according to FIG. 1 is realized by employing a test sensor 10 according to the invention. The FIGS. 5*a* and 5*b* show two preferred embodiments of such a test sensor 10, whose scanning unit 14 with the scanning sensor 19 is arranged to scan in spectrally resolved manner the test region 4, below which the value document 1 to be tested is guided past in the transport direction T at a transport speed between 1 m/s and 13 m/s, preferably between 4 m/s and 11 m/s.

The scanning unit 14 captures an emission radiation emitted by the luminescence feature 3 in a certain detection spectral range of the scanning sensor 19 and delivers emission spectral values E which reproduce the spectral properties of the scanned emission radiation. For exciting the luminescence feature 3 an excitation radiation source 13 irradiates the test region 4 with the excitation radiation L. The excitation radiation L is coordinated with the luminescence feature 3 such that an emission radiation is caused in the optical range, for example in the ultraviolet (UV), visible (VIS) or infrared spectral range (IR). The excitation radiation L here is preferably spectrally narrow-band, but can also be broadband or comprise a superposition of various narrow-band and/or broadband radiation proportions.

The test region 4 is additionally irradiated with the test radiation P by a radiation source 12 to ascertain by means of the remitted remission spectral values R the presence of a value document 1 in the test region 4 at the time point of scanning and/or to ascertain its expansion in the transport direction T by evaluating the resulting remission curve RC.

The test radiation source 12 here produces a test radiation P with a spectral distribution which partially or preferably completely overlaps the detection spectral range of the scanning unit 14 and/or of the scanning sensor 19. Particularly preferably, the test radiation P is spectrally narrow-band, and is verifiable in only one or few spectral channels of the scanning sensor 19. The produced test radiation P is preferably arranged spectrally such that it does not excite the luminescence feature 3 to any significant emission radiation. Preferably, the proportion of an emission radiation caused by the luminescence feature 3 of the intensity of the scanned remission spectral values R is preferably less than 10%.

The test radiation source 12 produces the test radiation P with a suitable light source, for example a light emitting diode or laser diode, particularly preferably with an edge emitter or a VCSEL or a VCSEL array. If required, additional optical units, filters or fluorescent substance converters are incorporated in the beam path of the test sensor 10 to ensure a desired, optionally narrow-band spectrum of the test radiation P with corresponding spectral overlap with the spectrum of the emission radiation emanating from the luminescence feature 3 in the detection spectral range of the scanning sensor 19. Here, the optics of the test sensor 10 is configured such that the test radiation P is coupled into a beam path to the scanning unit 14 by remission and/or scattering on the surface of a value document 1 as soon as the value document 1 moves into the test region 4.

Further, the test sensor 10 comprises a control/evaluation unit 17, which controls the test radiation source 12 and the excitation radiation source 13 such that a scanning sequence A in accordance with FIG. 3*a* or 3*b* is realized. The control/evaluation unit 17 also tests the value document 1 for authenticity and/or completeness by means of the ascertained remission curve RC and emission curve EC.

The test sensor 10 according to FIG. 5*a* directs the test radiation P directly onto the test region 4, and thus onto the value document 1, wherein also apertures or illumination optics can be used in addition. In the test region 4, locally overlapping with the test radiation P, the excitation radiation L from the excitation radiation source 13 is coupled in via a dichroic beam splitter 16 and directed with the optics 15 onto the value document 1 transported past. The excitation radiation source 13 here comprises, for example, a light emitting diode or a semiconductor laser, in particular a VCSEL or VCSEL array. Both the test radiation P remitted by the value document 1 and the emission radiation emitted by the luminescence feature 3 are coupled via the optics 15 into the scanning unit 14 and detected there in spectrally resolved manner by the scanning sensor 19. For this purpose, the scanning unit 14 comprises a spectrographic device 18 and the scanning sensor 19 that captures the spectral proportions and spectral components in spectrally resolved manner which are produced by the spectrographic unit 18.

In the test sensor 10 according to FIG. 5*b*, the irradiation of the value document 1 can alternatively be effected by means of a combined irradiation unit 11 comprising suitable irradiation sources 12, 13 for producing the test radiation and P and the excitation radiation L. In this embodiment of the test sensor 10 both radiations are coupled in together via the dichroic beam splitter 16 into the beam path of the test sensor 10 in the direction of the test region 4.

The typical polarization dependence in the spectral edge region of dielectric interference filters on dichroic mirrors can be utilized, for example by diverting a linearly polarized radiation (in particular test radiation) at a dichroic mirror with high reflectivity (preferably higher than 80%), while the radiation diffusely remitted by the value document 1 also comprises spectral proportions of the polarization component orthogonal thereto, which are thus transmitted sufficiently well, for example in a range of more than 40%.

The invention claimed is:

1. A method for testing a value document, which is guided past a test sensor in a transport direction, wherein a luminescence feature is present in substantially homogeneously distributed manner in or on a security region extending over the value document in the transport direction, wherein a scanning sequence that repeats itself multiple times upon guiding the value document past the test sensor, comprising the steps of:

irradiating a test region of the test sensor that overlaps the security region at least partially with an excitation radiation and a test radiation in a first irradiation phase, wherein the test radiation is arranged to be remitted by the value document at least partially in a detection spectral range of the test sensor, and the excitation radiation is arranged to cause an emission radiation of the luminescence feature in the detection spectral range;

scanning at least one location-dependent remission spectral value in the test region in the first irradiation phase;

irradiating the test region only with the excitation radiation in a second irradiation phase;

scanning at least one location-dependent emission spectral value in the test region in or after the second irradiation phase; and testing authenticity, according to which the value document is classified as authentic or inauthentic on the basis of the at least one location-dependent remission spectral value scanned multiple times in spatially resolved manner, and the at least one location-dependent emission spectral value scanned multiple times in spatially resolved manner;

wherein the at least one location-dependent remission spectral value comprises proportions of remitted test radiation and proportions of the emission radiation of the luminescence feature;

wherein a duration of the first irradiation phase is shorter than a duration of the second irradiation phase.

2. The method according to claim 1, wherein a dimension of the value document in the transport direction is ascertained by means of a number of significant remission spectral values, wherein an emission spectral value and/or a remission spectral value is considered significant when it is above a lower threshold value and optionally below an upper threshold value.

3. The method according to claim 2, wherein for the authenticity test the number of significant remission spectral values is tested to the number of significant emission spectral values.

4. The method according to claim 1, wherein the value document is classified as authentic when a spatially resolved remission curve formed from the at least one location-dependent remission spectral value scanned multiple times and a spatially resolved emission curve formed from the at least one location-dependent emission spectral value scanned multiple times have a qualitatively comparable curve progression.

5. The method according to claim 4, wherein a dimension of the value document in the transport direction is ascertained by means of a number of significant remission spectral values under the remission curve, and the remission curve and the emission curve are considered qualitatively comparable when the emission curve has significant emission spectral values substantially in such locations in which also the remission curve has significant remission spectral values.

6. The method according to claim 1, wherein the duration of the first irradiation phase is between 0.5 μs and 500 μs, and a ratio between the duration of the first irradiation phase and a time duration of the scanning sequence is between 1:1000 and 1:4, wherein a transport speed at which the value document is guided past the test sensor is between 1 m/s and 13 m/s.

7. The method according to claim 1, wherein the scanning of the at least one remission spectral value is effected towards an end of the first irradiation phase, wherein the second irradiation phase immediately follows the first irradiation phase, and in that the scanning of the at least one emission spectral value is effected towards an end of the second irradiation phase, wherein the scanning sequence begins again after concluding the second irradiation phase.

8. The method according to claim 1, wherein the scanning sequence comprises a resting phase following the second irradiation phase, in which resting phase the value document is not irradiated by the test sensor, wherein the scanning sequence begins again after concluding the resting phase and the scanning of the at least one location-dependent emission spectral value is effected in the resting phase, towards an end of the resting phase.

9. The method according to claim 1, wherein multiple scanning of at least one location-dependent emission spectral value within the scanning sequence, wherein a rise/decay behavior of the luminescence feature is ascertained by means of the several scanned, at least one emission spectral values, said behavior being taken into account in the test.

10. The method according to claim 1, wherein by means of at least one emission spectral values scanned within one single scanning sequence a location-dependent authenticity test is carried out by comparing the scanned at least one emission spectral values with reference spectral values and/or by ascertaining by means of several scanned at least one emission spectral values a rise/decay behavior of the luminescence feature, which is compared with a reference rise/decay behavior.

11. The method according to claim 1, wherein the value document is irradiated with a narrow-band test radiation, which is arranged to cause no or only a weak emission radiation of the luminescence feature in the detection spectral range, and is irradiated with a, preferably narrow-band, excitation radiation in an ultraviolet, visible and/or infrared spectral range.

12. The method according to claim 1, wherein the test radiation is produced by a test radiation source, which comprises an LED or semiconductor laser radiation source, and that the excitation radiation is produced by an excitation radiation source, which comprises an LED or semiconductor laser radiation source.

13. The method according to claim 1, wherein the scanned remission spectral values and/or emission spectral values are corrected by substantially eliminating from the remission spectral values and/or the emission spectral values scatter radiation proportions or electronic disturbing radiation proportions by an offset correction, wherein correction parameters of the offset correction are ascertained by the test sensor by scanning a reference substrate or by the test sensor by scanning prior to a first scanning sequence or by the test sensor by scanning between the first scanning sequence and a subsequent scanning sequence respectively corresponding to value documents guided past the test sensor.

14. The method according to claim 1, wherein the scanned remission spectral values are corrected by extracting those spectral proportions from the remission spectral values which result from remitted radiation proportions of the test irradiation and/or eliminating those spectral proportions from the remission spectral values which result from the emission radiation of the luminescence feature.

15. The method according to claim 4, wherein an offset between the remission curve and the emission curve resulting from guiding the value document past the test sensor is compensated for by shifting the emission curve relative to the remission curve by the time duration between the scanning of the at least one remission spectral value and the scanning of the at least one emission spectral value.

16. The method according to claim 4, wherein a transport speed at which the value document is guided past the test sensor and the time duration of the scanning sequence are mutually coordinated such that the remission curve and/or the emission curve has a spatial resolution that is sufficient for a reliable authenticity test.

17. A test sensor for testing a value document or authenticity, comprising:

a test radiation source adapted to produce a test radiation which is remitted by the value document at least partially in a detection spectral range of the test sensor;

an excitation radiation source adapted to produce an excitation radiation which causes a luminescence feature present in or on the value document to emit an emission radiation in the detection spectral range;

a scanning unit adapted to scan test radiation remitted and emission radiation emitted by the value document in the detection spectral range; and an evaluation unit adapted to classify the value document as authentic or inauthentic;

wherein the test sensor is adapted, while the value document is guided past the test sensor, to repeat a scanning sequence multiple times within the scope of which the value document is irradiated by the test radiation source and by the excitation radiation source in a first irradiation phase and is irradiated only by the excitation radiation source in a second irradiation phase, wherein the scanning unit scans at least one location-dependent remission spectral value in the first irradiation phase and scans at least one location-dependent emission spectral value in or after the second irradiation phase, wherein the evaluation unit is adapted to classify the value document as authentic or inauthentic on the basis of the at least one location-dependent remission spectral values scanned multiple times in spatially resolved manner and the at least one location-dependent emission spectral values scanned multiple times in spatially resolved manner;

wherein the at least one location-dependent remission spectral value comprises proportions of remitted test radiation and proportions of the emission radiation of the luminescence feature;

wherein a duration of the first irradiation phase is shorter than a duration of the second irradiation phase.

18. The test sensor according to claim 17, wherein the evaluation unit classifies the value document as authentic when a spatially resolved remission curve formed from the at least one location-dependent remission spectral value scanned multiple times and an emission curve formed from the at least one spatially resolved emission spectral value scanned multiple times have a qualitatively comparable curve progression.

19. The test sensor according to claim 17, wherein the test sensor is configured and adapted to test a value document guided past the test sensor for authenticity and/or completeness.

20. A testing device, comprising a test sensor according to claim 17, and a transport device adapted to transport a value document past the test sensor in the transport direction, such that the value document can be tested for authenticity and/or completeness.

21. Use of a test sensor according to claim 17 for testing a value document for authenticity and/or completeness.

22. The test sensor according to claim 17, wherein the duration of the first irradiation phase is between 0.5 μs and 500 μs, and a ratio between the duration of the first irradiation phase and a time duration of the scanning sequence is between 1:1000 and 1:4, wherein a transport speed at which the value document is guided past the test sensor is between 1 m/s and 13 m/s.

23. A method for testing a value document, which is guided past a test sensor in a transport direction, wherein a luminescence feature is present in substantially homogeneously distributed manner in or on a security region extending over the value document in the transport direction, wherein a scanning sequence that repeats itself multiple times upon guiding the value document past the test sensor, comprising the steps of:

irradiating a test region of the test sensor that overlaps the security region at least partially with an excitation radiation and a test radiation in a first irradiation phase, wherein the test radiation is arranged to be remitted by the value document at least partially in a detection spectral range of the test sensor, and the excitation radiation is arranged to cause an emission radiation of the luminescence feature in the detection spectral range;

scanning at least one location-dependent remission spectral value in the test region in the first irradiation phase;

irradiating the test region only with the excitation radiation in a second irradiation phase; and scanning at least one location-dependent emission spectral value in the test region after the first irradiation phase;

wherein a time duration of the first irradiation phase is between 0.5 μs and 500 μs, and a ratio between the time duration of the first irradiation phase and a time duration of the scanning sequence is between 1:1000 and 1:4, wherein a transport speed at which the value document is guided past the test sensor is between 1 m/s and 13 m/s.

* * * * *